United States Patent [19]

Pasquier

[11] Patent Number: 4,511,260

[45] Date of Patent: Apr. 16, 1985

[54] IMPROVED QUARTZ WATCH HAVING A SEMI-RIGID WATCH CASE BOTTOM AND A TIME SETTING SYSTEM USING AN ELECTRICAL CONTACT

[76] Inventor: René Pasquier, 18 Bis, rue Burgat-Charvillon, 74000 Annecy, France

[21] Appl. No.: 510,769

[22] Filed: Jul. 5, 1983

[30] Foreign Application Priority Data

Jul. 6, 1982 [FR] France ..... 82 12048

[51] Int. Cl.[3] ..... G04C 17/00

[52] U.S. Cl. ..... 368/69; 368/224; 368/309; 368/319

[58] Field of Search ..... 368/69, 70, 224, 319, 368/320, 309

[56] References Cited

FOREIGN PATENT DOCUMENTS 2011390 2/1970 France .
2350633 12/1977 France .
15622 8/1977 Switzerland .

OTHER PUBLICATIONS

Patents Abstracts of Japan, vol. 6, No. 62 (P-111) (940), dated Apr. 21, 1982.

*Primary Examiner*—Bernard Roskoski
*Attorney, Agent, or Firm*—Parkhurst & Oliff

[57] ABSTRACT

Watch constituted by a quartz mechanism, in which the mechanism does not rest on the bottom of the case and comprises a watch time-setting system by electrical contact between the positive pole of a battery and the negative pole of an electronic module containing the time-setting program.

The rear face of the mechanism comprises means directed so as to face the bottom of the watch case, and make an electrical contact between the two said poles.

The bottom of the watch case is produced from a semi-rigid material having a thickness that decreases progressively for its entire length from the case periphery towards its center and increases close to the center to form a projection. The bottom is capable of becoming elastically deformed under a force, so that, the effect of said force exerted on the bottom, actuates the means designed to make a contact between said two poles, for setting the mechanism to the right time.

3 Claims, 8 Drawing Figures

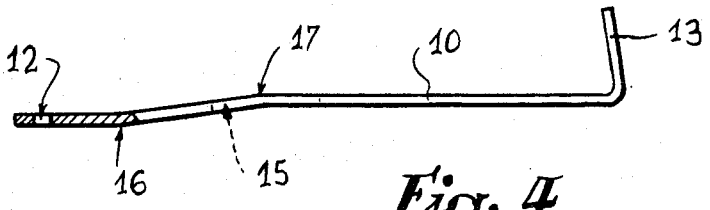
Fig. 4
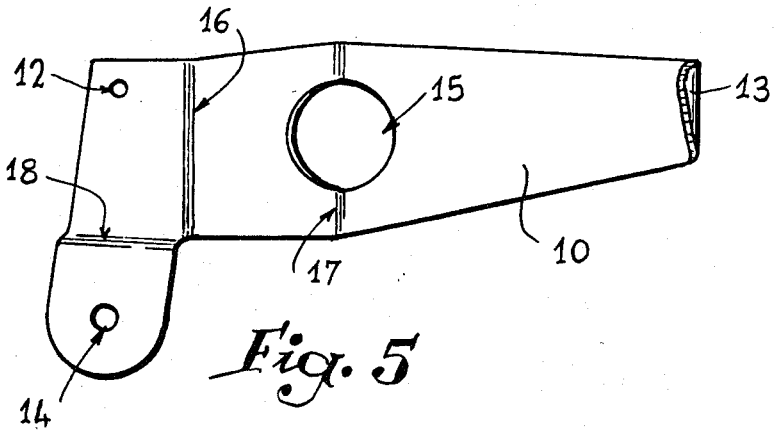
Fig. 5
Fig. 6
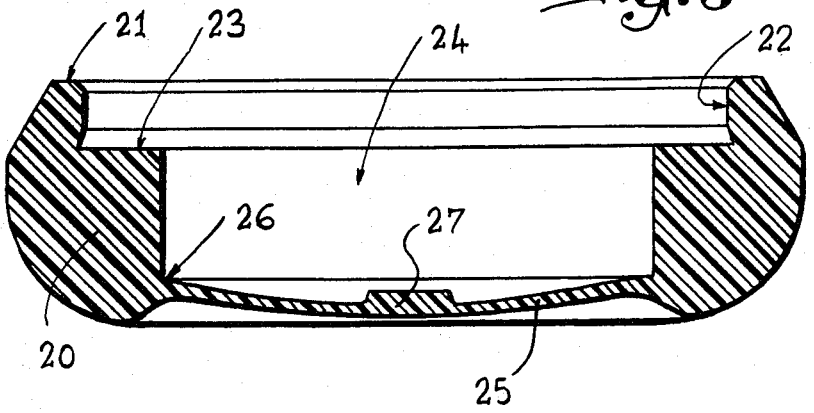

IMPROVED QUARTZ WATCH HAVING A SEMI-RIGID WATCH CASE BOTTOM AND A TIME SETTING SYSTEM USING AN ELECTRICAL CONTACT

BACKGROUND AND SUMMARY OF THE INVENTION

The present invention relates to a new improved quartz watch and more particularly to a new type of waterproof watch case, especially adapted for quartz watches.

It is a wellknown fact, in the watch-making industry, that the case is an essential element of the watch. For various reasons, the watch case has to be waterproof and damp-proof. Present metallic cases are mostly monoblock or have a screwing-in base.

Any winders and press-members have to go through these cases, and because of this, joints are necessary to ensure tightness of the assembly. But with time, these joints become caked up with dirt and harden, which reduces tightness. And, at the present stage of the technique, winders and press-members are still necessary for setting the watch to the right time.

It is also known that in the mechanism of a quartz watch the press-member actuates a spring which makes a contact between the positive pole of the battery and the negative pole of the electronic module containing the watch-setting program. Depending on the nature of the pulse delivered by the press-member, the hands are then brought forward, either minute by minute (short pulse), or hour by hour (average pulse) or continuously (slow pulse). But with this solution, the presence of a press-member necessitates joints which, with time, will diminish the tightness of the whole assembly.

It is the object of the present invention to overcome the aforesaid drawbacks by proposing an improved quartz watch which is perfectly waterproof and in which time-setting does not necessitate to use press-members or winders, i.e. pin members traversing the watch case.

The improved watch according to the invention, of the type constituted by an electronic mechanism with quartz resonator, placed inside a monobloc rigid case, covered by a protective glass, and in which the mechanism does not rest on the bottom of the case and comprises a watch time-setting system by electrical contact between the positive pole of the battery and the negative pole of the electronic module containing the time-setting program, is characterized in that:

- on the one hand, the rear face of the mechanism comprises means directed so as to face the bottom of the watch case, and make an electrical contact between the two said poles,
- and on the other hand, the bottom of the watch case is produced from a semi-rigid material, capable of becoming elastically deformed under a force, so that the effect of said force exerted on the bottom actuates the means designed to make a contact between said two poles, for setting the mechanism to the right time.

A digital display watch is already described in German Utility Model No. 76 15209, in which the watch case, in plastic material, is provided at the front with two parts which may be subjected to the action of a pressure deforming it elastically. Said deformable parts are used to actuate contacts, causing the display of either the hours and the minutes, or the minutes and the seconds. This is therefore a time-display system, and not a system for setting a watch to the correct time. The physical structure, functions, and results of this device are different from those aimed at in the invention. Moreover, the combination of the teaching of this Utility Model with the time-setting electronic module was not at all obvious since, on the one hand, the functions used are not the same, and on the other hand, the time-setting electronic module had to be adapted, meaning that, the shape and functions of the contact plate had to be modified by lengthening said plate and moving its anchoring point so as to ensure elasticity.

U.S. Pat. No. 4,244,044 describes a watch in which the control and corrections are carried out by pressing on the glass which is removably mounted. This is again a different structure.

Advantageously and in practice, in the watches according to the invention:

- the deforming force is a pressure but could also be a traction;
- the electrical contactor is constituted by a metal plate which conducts electricity and which is supple and elastic, and known as contact plate, for example a plate in copper or copper-plated steel; said plate is fixed at one end to the cock of the electronic watch mechanism in order to form the positive pole of the battery, whereas the other end of said plate is free and can be brought into contact with the negative pole of the electronic module under the effect of a force exerted on the strip by the finger through the flexible base of the case; according to a special embodiment, and for safety's sake, the fixed end of the plate is also attached to a second anchoring point on the mechanism;
- the watch case is monobloc, made from a rigid plastic material, and comprises no opening except for that designed to receive the glass;
- the watch case is made from an injected or machined plastic material;
- the thickness of the bottom of the case decreases progressively from the case periphery towards its center, but it increases close to said center, so as to form a projection by which a pressure can be exerted with the finger on the plate which faces said projection from inside the case;
- the watch case is made of metal, but comprises a built-in plastic bottom, the thickness of which reduces progressively from the periphery towards the center;
- the bottom of the case is zigzag-pleated so as to be able to receive a deforming pressure, from the finger for example.

BRIEF DESCRIPTION OF THE DRAWINGS

The invention will be more readily understood on reading the following description with reference to the accompanying drawings, in which:

FIGS. 4 and 5 show the said winder contact plate, respectively in profile and diagrammatical perspective;

FIG. 6 is a diagrammatical cross-section of a watch case according to the invention.

DETAILED DESCRIPTION OF THE PREFERRED EMBODIMENT

Figure 1:
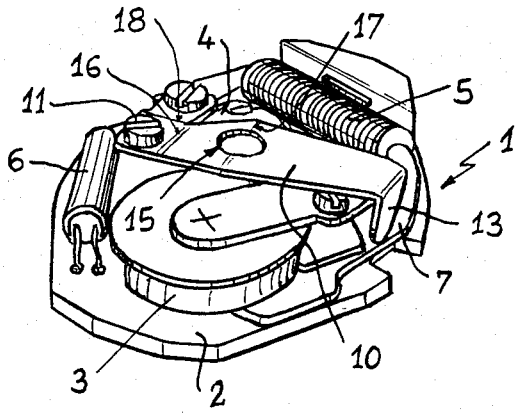
FIG. 1 is a diagrammatical perspective showing the mechanism of a quartz watch equipped with a winder plate according to the invention.
Figure 2:
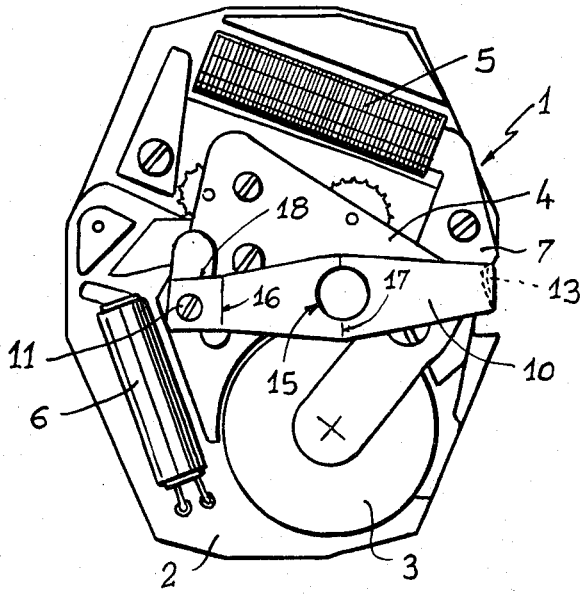
FIG. 2 is a plan view of the same mechanism.
Figure 3:
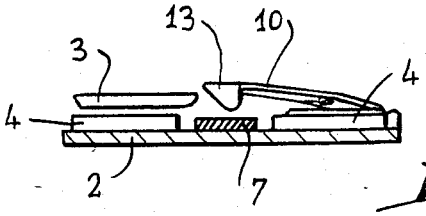
FIG. 3 is a cross-sectional view of said mechanism taken on the level of the plate.

Referring first to FIGS. 1 and 2, the electronic mechanism 1 with quartz resonator, of the type marketed under reference FR 205 by the French company FRAMELEC, of Morteau, essentially comprises, in known manner:

- a mounting plate 2 on which rests, right side up, the conventional dial 31 and hands 32 and 33, and wrong side up, (FIGS. 1 to 3), the battery 3 of for example of 1.5 volts with high impedance, which battery is connected in conventional manner to the watch-cock 4, which is for example nickle-plated or
- a coil 5;
- an electronic module 6 with its time-setting program by advancing of one minute, one hour or continuously;
- a contact 7 forming a negative pole of the electronic module 6.

According to an original feature of the invention, the mechanism 1 comprises an elastic conducting plate 10 forming contact (see FIGS. 4 and 5), for example in copper or any other conducting alloy such as special steel. Said contact plate 10 of about 4 mm width is of a similar type to those used in the manufacture of pressure springs designed to start off the alarm of a clock. Said plate 10 is provided at one end with an orifice 12 designed for fixing the plate to the watchcock 4 by means of a screw 11, so as to form the positive pole of the battery 3. Said plate 10 can optionally be bent in 16, 17 or 18 to improve its suppleness and elasticity. The anchoring point 11 of the plate 10 in the watchcock 4 which, as already indicated, form the positive pole of the battery 3, is situated as far as possible from the free opposite end 13, which is also bent and this, in order to give more length of action, hence more sensitivity to the assembly.

Advantageously, to ensure a better geometrical position of the assembly, the plate 10 is secured to the mechanism 1 in two fastening points 11 and 14 and it is provided in its center with an orifice 15 designed to receive the hands 32, 33.

When the plate 10 is in the rest position, its free end is apart from the contact point 7. On the contrary, with a slight pressure, of the finger for example, through the bottom of the case, said end 13 is then brought in contact with the point 7 thus making an electrical contact. If on the contrary, said pressure is released, the plate 10 and therefore its end 13 return to their initial position and the contact circuit is then broken (See FIGS. 7 and 8).

In known manner, when contact is on between the end 13 and the point 7, the electronic module 6 then drives the motor in a step-by-step rotation and depending on the intensity and duration of said contact (whether short or long), the hands are then advanced either minute by minute or hour by hour, or continuously.

The case 20 (See FIG. 6) is made from any known material. Advantageously, said case is made of rigid plastic material, injection-molded or even machined. ABS resins or mixtures of ABS resins with polycarbonate can be used. Said resin is advantageously colored, especially through the mass.

If necessary, the said case can also be a metal case, of which the bottom comprises a bellows or accordeon shaped central part, thus enabling said bottom to deform elastically.

Said monobloc case 20 comprises, in known manner, an upper face or window 21 into which the curved or flat glass 30 is forced-fitted to rest against support 22, said glass being preferably ringed and tightly gripped to ensure protection and tightness.

The mounting plate 2 rests on the horizontal member 23, so that the mechanism is suspended inside the central space 24 provided in said case.

The bottom 25 of the monobloc case 20 is made from a semi-rigid elastic material adapted to deform under a pressure or traction force applied by hand. Advantageously, the thickness of the bottom 25 of the case 20 should be sufficient to give rigidity to the whole assembly and to ensure perfect tightness, as well as to obtain good mechanical as well as physical resistance. But, as already indicated, said bottom 25 also needs to be semi-supple and elastic so that, under the effect of a simple pressure applied by the finger on the bottom, the latter can deform and thus enable to push the contact plate 10 through said bottom 25 and thus to bring the free end 13 of said strip in contact with the negative point 7.

Moreover, like the contact plate 10, this semi-rigid bottom 25 also needs to be elastic, namely that said bottom can return to its initial position with the minimum of hysteresis as soon as the pressure or traction force stops. Finally, said bottom 25 should not be too supple so as not to cause any jerky contacts. As already indicated, the thickness of the bottom 25 decreases from the periphery of the bottom of space 24 towards the center 27, but it increases close to said center 27 to form a projection. Thus, this difference of thickness, first progressive, and then the reverse, improves the suppleness, aids the contact and increases the sensitiveness of the bottom 25 by creating a spring effect. In practice, the progressing thickness of the periphery towards the center is between 0.5 and 1 mm. According to a variant, the projection 27 goes through orifices 15 and it is the periphery of the projection 27 which causes the plate 10 to move.

Figure 7:
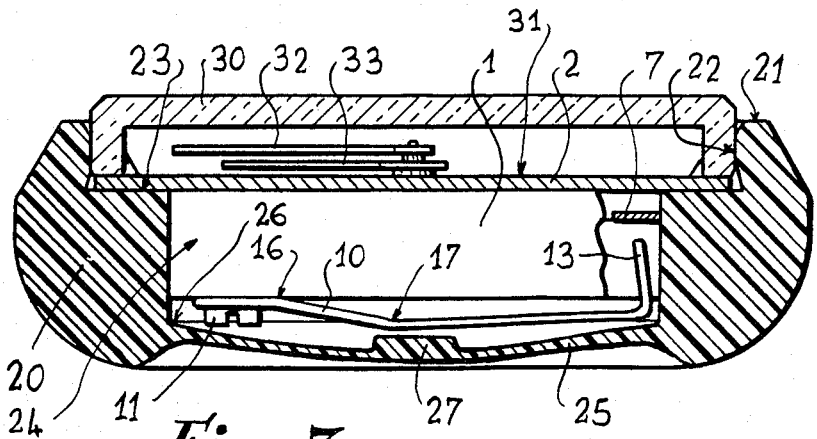
FIGS. 7 and 8 give a simplified cross-sectional view of a watch according to the invention, in the rest position (FIG. 7) and in the winding up position (FIG. 8), respectively.
Figure 8:
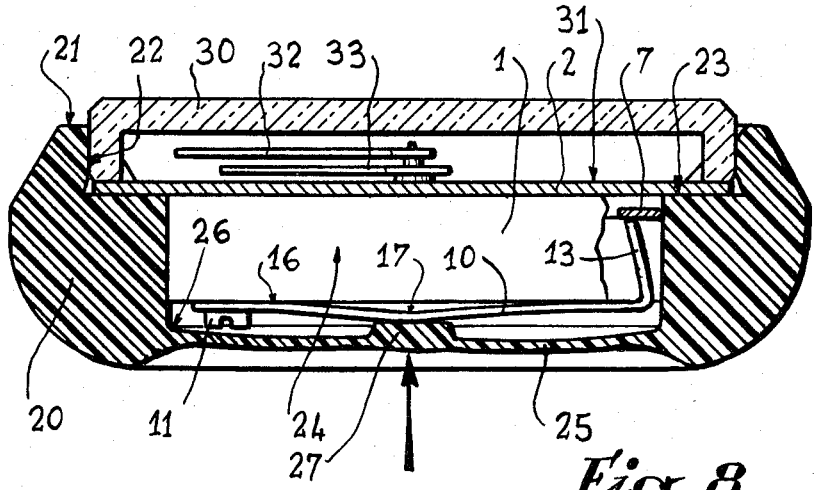

When the mechanism 1 is placed inside the case 20, the mounting-plate 2 rests only on the horizontal support 23. In the rest position, the strip 10 does not touch any part of the bottom 25 or to be more precise of the projection 27 (FIG. 7). On the contrary, under the effect of a simple pressure of the finger in 27 (FIG. 8), projection 27 touches and then pushes the contact plate 10, until its end 13 touches the negative contact 7 and thus makes the electrical contact. As already indicated, depending on the nature and duration of said connection, the hand 32–33 will be moved forward minute by minute, hour by hour or continuously.

According to a special embodiment particularly adapted for diving watches, the bottom 25 is provided in its center with an outwardly-directed projection which is connected on the inside with the plate 10, then mounted for pivoting about a pivot pin. By drawing said projection 27 outwards, the strip is then caused to pivot, thus making an electrical contact with the point 7.

According to another embodiment, particularly adapted to the metal case, the bottom of the case is accordeon-folded or bellows-shaped so as to be able to deform under the effect of an outside pressure.

Watches produced according to the invention have many advantages over the present ones. Since there is no openings besides the opening for the window 21 which is necessary for setting in the glass 30, tightness is virtually perfect.

And since there is no press-member or winder, there is no risk of stems braking or of accidents linked to the deterioration of joints.

Finally, the time-setting device 6 is hardly modified, this permitting to this system to be easily adapted to some of the currently used mechanisms.

The watches thus produced are perfectly waterproof, which, up to now, was never really achieved.

The invention finds applications in other fields besides watches for example it can be applied to clocks or chronometers.

What I claim is:

1. A watch of the type comprising:

a plastic semi-rigid movable case covered by a protective transparent face, hands, an electronic mechanism with quartz resonator located inside the case, and in which said mechanism does not rest on the bottom of the case which is a semi-rigid material capable of being elastically deformed under force, and recovering its initial position, the said mechanism comprising time-setting means by electrical contact between the positive pole of a battery and the negative pole of an electronic module containing a time-setting program, the rear face of the mechanism comprising means facing the bottom of the watch case for making an electrical contact between the two said poles, so that in response to a force exerted on the bottom of the casing, the means designed to make a contact between said two poles is activated, for setting the mechanism to a desired time and wherein;

the thickness of the bottom of the case decreases progressively for its entire length from the case periphery towards its center, but increases close to said center to form a projection for resting on said contact means.

2. A watch as claimed in claim 1, wherein the contact means comprises a metal plate which conducts electricity and which is supple and elastic, and that is fixed at one end to the watch cock of the electronic watch mechanism to form the positive pole of the battery, whereas the other end of said plate is free and can be brought into contact with the negative pole of the electronic module under the effect of a force exerted through the flexible base of the case.

3. An improved watch comprising an electronic mechanism with quartz resonator, located inside a monobloc casing in plastic material, the top of which is covered by a protective transparent face whereas the bottom is elastically deformable, and in which the mechanism:

comprises a time-setting system by electric contact between the positive pole of a battery and the negative pole of an electronic module containing a time-setting program, the mechanism being located such that it does not rest on the bottom of the case, and wherein:

the thickness of the bottom of the case decreases progressively for its entire length from the case periphery towards its center, but increases close to said center, to form a projection, and the back face of the mechanism comprises a metal plate which conducts electricity and is supple and elastic, and fixed at one of its ends in two points to the watchcock to form the positive pole of a battery, whereas the free end can be brought in contact with the negative pole of the electronic module under the effect of pressure exerted on the strip through the supple bottom of the case at the level of the projection.

* * * * *